US006588193B2

(12) United States Patent
Hayes

(10) Patent No.: US 6,588,193 B2
(45) Date of Patent: Jul. 8, 2003

(54) CORROSION RESISTANT TENDON SYSTEM

(76) Inventor: Norris Hayes, 14030 Florence Rd., Sugar Land, TX (US) 77478

( * ) Notice: Subject to any disclaimer, the term of this patent is extended or adjusted under 35 U.S.C. 154(b) by 0 days.

(21) Appl. No.: 09/808,881

(22) Filed: Mar. 15, 2001

(65) Prior Publication Data

US 2001/0011069 A1 Aug. 2, 2001

Related U.S. Application Data

(62) Division of application No. 09/480,036, filed on Jan. 10, 2000, which is a division of application No. 08/964,437, filed on Nov. 4, 1997, now abandoned.

(51) Int. Cl.[7] ..... D07B 1/16
(52) U.S. Cl. ..... 57/223
(58) Field of Search ..... 57/210, 212, 235, 57/258, 259, 232, 233, 234, 223

(56) References Cited

U.S. PATENT DOCUMENTS 3,646,748 A * 3/1972 Lang ..... 57/149
4,473,936 A * 10/1984 Kellner et al. ..... 29/258

* cited by examiner

*Primary Examiner*—Danny Worrell
*Assistant Examiner*—Shaun R Hurley

(57) ABSTRACT

A mono-strand tendon for unbonded post-tension construction. A mono-strand wire tendon having interstices between the individual wires is formed with a corrosion resistant material between the tendon interstices. A first sheath is positioned around the tendon exterior surface, and corrosion resistant material is positioned between the tendon exterior surface and the first sheath. A second sheath can be positioned around the first sheath, and a lubricant or corrosion resistant material can be placed between the first and second sheaths. The corrosion resistant material can be positioned within the interstices of the mono-strand tendon by displacing one or more of the wire strands away from the other wire strands to open up the interstices. Corrosion resistant material can be placed on the wire strands, and the displaced wire strand can be released to reform the exterior surface of the tendon and to compact the corrosion resistant material within the interstices.

9 Claims, 2 Drawing Sheets

CORROSION RESISTANT TENDON SYSTEM

Pursuant to CFR. 1.60, this Application is a divisional patent application of U.S. Ser. No. 09/480,036 filed Jan. 10, 2000, entitled "Method for Creating Corrosion Resistant Tendon", which was a divisional patent application of U.S. Ser. No. 08,964,437 filed Nov. 4, 1997 now abandoned, entitled "Corrosion Resistant Tendon System".

BACKGROUND OF THE INVENTION

The present invention relates to the field of post-tension tendons for constructing concrete structures. More particularly, the invention relates to a corrosion resistant, unbonded mono-strand tendon system for post-tension construction.

Mono-strand tendons for unbonded post-tension construction typically comprise a seven wire strand tendon placed within an elastomeric sheath. The seven wire tendon is formed with six wires helically wrapped around a central core wire. Grease or another lubricant is placed on the outer surface of the seven strand wire tendon adjacent to the elastomeric sheath to facilitate movement between the tendon and the sheath, and to resist corrosion created by air and water infiltration between the tendon and sheath.

Tendon corrosion is a significant concern in post-tensioned systems. Such corrosion occurs when water, salt and other corrosive agents contact the tendon materials. Because the strength of post-tension concrete systems depends on the tensile strength of the steel tendons, failure of the tendons can lead to failure of the entire structure. Tendon failure typically occurs due to water intrusion into the interstices between the tendon and surrounding concrete. Certain environments around salt water and other highly corrosive factors require extra caution in designing special corrosion resistant post-tension systems.

The installation of post-tension tendons typically occurs in a rugged construction environment where the tendons can be damaged by equipment, careless handling, and contact with various site hazards. When the elastomeric sheath is punctured, a water leak path into contact with the tendon is established. The puncture must be patched to resist water intrusion between the sheath and tendon as concrete is poured around the post-tension tendon, and before the concrete cures. The puncture and patch can create a discontinuity between the tendon and the sheath, and this discontinuity can impede proper post-tensioning of the tendon after the concrete has cured.

One conventional technique for providing extra protection in corrosive environments is to increase the thickness of the plastic sheath covering the tendon. A plastic sheath at least forty mils thick is formed around the tendon to resist abrasion and puncture damage. Although this approach provides incremental protection against leakage, a thicker sheath does not provide redundant protection to the tendon steel.

Another anti-corrosion technique for providing corrosion resistance uses tendon end sealing systems having seals and grease-filled pockets for blocking water intrusion and to resist water intrusion into the tendon core. Intermediate cover caps permit passage of the sheathed tendon during installation, and grease-filled end cover caps seal the tendon end against water intrusion. Oil or grease is sometimes pumped into the end of the tendon end to fill the interstices at the tendon ends, however this procedure does not protect the internal wire strands forming the tendon. The penetration depth of end seal protection is sometimes extended by short corrosion protective sleeves or adapter tubes which extend for several feet from the end cap into the concrete. Such adapter tubes have a seal around the tendon exterior surface and form have a pocket for packing grease or other corrosion inhibitor near the tendon ends.

Another technique for resisting high corrosion environments is to specially treat the individual wire strands within a mono-strand tendon. One such process coats each wire strand with an electrostatic fusion-bonded epoxy to a thickness between one and five mils thick. Similar wire strand techniques use galvanized wire and other corrosive resistant wires within the multiple wire tendons to form a corrosion resistant tendon.

Another conventional post-tension system for highly corrosive environments uses a seamless plastic tube secured to encapsulated anchors at each end. The mono-strand tendon is placed within the plastic tube and is theoretically protected from water intrusion within the cavity formed by the plastic tube. However, a puncture or leak at any point along the plastic tube or at the connections between the tube and the end anchors can permit water intrusion into contact with the mono-strand tendon, thereby permitting corrosion to occur.

Significant effort has been made to create improved corrosion resistant materials compatible with the exterior sheaths and resistant to corrosion. Corrosion resistant materials typically have an affinity to metal and are capable of displacing air and water. Additionally, such materials are relatively free from tendon attacking contaminants such as chlorides, sulfides and nitrates. However, the effectiveness of such corrosion resistant materials is limited by the system design placing such materials into effective contact with the individual tendon wire strands.

A need exists for improved post-tension tendons which resist corrosion and consequential failure of the post-tension structure. The tendons should be compatible with existing tensioning procedures and should resist the risk of water intrusion into contact with the internal wire strands.

SUMMARY OF THE INVENTION

The present invention discloses an unbonded post-tension tendon comprising a mono-strand tendon formed with at least two wire strands and having an exterior surface and having interior interstices between said wires, a first sheath around the tendon exterior surface, and a corrosion resistant material positioned within the tendon interstices and between the tendon exterior surface and the first sheath.

In various embodiments of the invention, a second sheath can be positioned about an exterior surface of the first sheath and a lubricant or a corrosion resistant material can be positioned between the first and second sheaths. The mono-strand tendon can comprise six wires helically wrapped about a center wire to form helical grooves on the tendon exterior surface, and the first sheath can have a thickness less than ten millimeters tightly wrapped about the tendon to form helical grooves in the first sheath exterior surface. Corrosion resistant material can be placed in the helical grooves between the tendon exterior surface and the first sheath, or in the helical grooves between the sheath exterior surface and the second sheath.

BRIED DESCRIPTION OF THE DRAWINGS

DESCRIPTION OF THE PREFERRED EMBODIMENTS

The invention provides a new post-tension tendon system particularly useful in unbonded, mono-strand applications. Unbonded post-tension systems require relative movement between a tendon and the cured concrete to permit tensioning of the tendon before the free end tendon anchor is set. Standard specifications for unbonded post-tension systems require a seven-wire, uncoated and stress-relieved steel strand. The term "strand" refers to a seven-wire tendon having a center wire enclosed tightly by six helically placed outer wires with a uniform pitch of not less than 12 and not more than 16 times the nominal diameter of the strand. The base metal for the strand is specified to be carbon steel having defined properties when drawn to wire, fabricated into strand, and stress relieved pursuant to required specifications.

The present invention provides an improved tendon system particularly suited to unbonded, post-tension concrete structures. While bonded tendons are used for bridge spans and other applications having prestressed concrete, unbonded systems depend on the compression of the concrete after the concrete has been poured and cured to entrain the tendons. The tendons are "post-tensioned" to stretch the tendons relative to the concrete and are anchored to compress the concrete.

Figure 1:
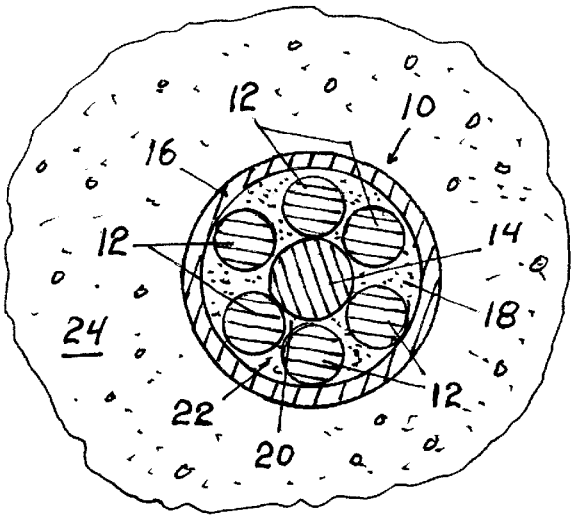
FIG. 1 illustrates one embodiment of the invention wherein a mono-strand tendon is enclosed with a first sheath.

FIG. 1 illustrates a sectional view where mono-strand wire tendon 10, formed with individual wire strands 12 about center wire strand 14, is positioned within first sheath 16. Wire strands 12 are helically wrapped about center wire strand 14, and form helical grooves on the exterior surface of tendon 10. Such helical grooves are cumulatively identified as shaped annulus 18 which defines the space between tendon 10 and the interior cylindrical surface of first sheath 16.

Because wire strands 12 are circular in cross-section, spaces between adjacent wire strands 12 and center wire 14 are cumulatively identified as tendon interior interstices 20. As shown in FIG. 1, annulus 18 and interstices 20 are filled with corrosion resistant material 22. Grease or another suitable material can be used for corrosion resistant material 22 to eliminate air pockets and to resist water intrusion into contact with wire strands 12. By filling annulus 18 with corrosion resistant material 22, the interior surface of first sheath 16 is substantially cylindrical, thereby facilitating relative movement between tendon 10 and first sheath 16 after concrete 24 has cured around the exterior surface of first sheath 16.

Figure 2:
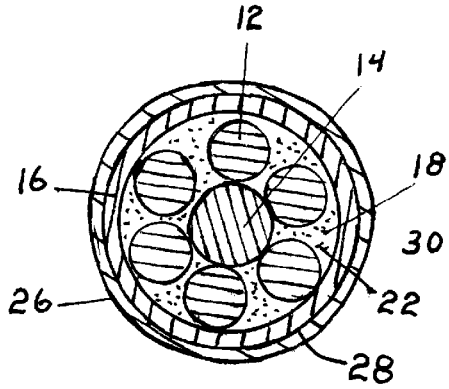
FIG. 2 illustrates an embodiment of the invention wherein a second sheath enclosed the first sheath.
Figure 3:
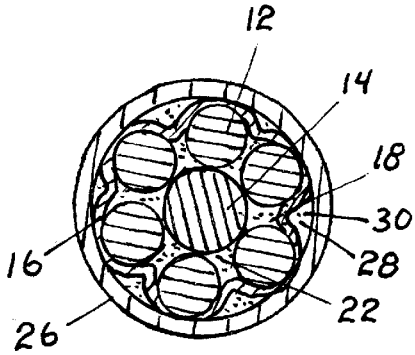
FIG. 3 illustrates a first sheath closely formed to the tendon exterior surface.

FIGS. 2 and 3 illustrate other embodiments of the invention wherein second sheath 26 is formed about first sheath 16. Annulus 28 is formed between second sheath 26 and first sheath 16, and is filled with a lubricant 30 to facilitate sliding movement therebetween. Lubricant 30 can comprise a corrosion resistant material similar to material 22. In FIG. 2, annulus 28 is substantially cylindrical. In FIG. 3, first sheath 16 is tightly formed about the exterior surface of tendon 10 and helical grooves, filled with corrosion resistant material, are formed in the exterior surface of first sheath 16. This embodiment of the invention preferably uses a material for first sheath 16 having a thickness less than ten mils. Conventional membranes are typically twenty-five mils thick for regular systems and forty mils thick for high corrosion resistant, encapsulated systems. By providing a slim first sheath 16 about tendon 10 which is capable of fitting tightly about tendon 10 to create grooves in the exterior surface of first sheath 16, corrosion resistant material 30 can be stored in annulus 28 to facilitate sliding movement therebetween and to resist intrusion by water or other contaminants into contact with first sheath 16 or tendon 10.

Figure 4:
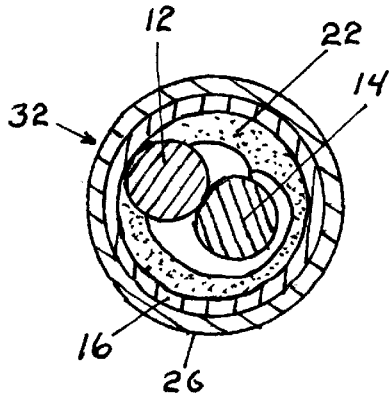
FIG. 4 illustrates a single wire strand wound about a center wire.

FIG. 4 illustrates another embodiment of the invention wherein a single wire strand 12 is helically wrapped about center wire 14 to form tendon 32. If it is desirable for the exterior surface of tendon 32 to be substantially cylindrical, the amount of corrosion resistant material 22 placed in contact with tendon 32 will depend upon the tightness of the windings and the spacings therebetween. If wire strand 12 is closely wound about center wire 14, the void space forming the annulus between tendon 32 and first sheath 16 will be reduced. Although this embodiment of the invention illustrates wire strand 12 hellically wrapped about center wire 14, it will be appreciated that two wire strands 12 could be substituted as a substantially equivalent structure within first sheath 16. The principal different between these two embodiments would be the tensile force exerted upon each wire strand and the shape and volume of the annulus between tendon 32 and the interior surface of first sheath 16.

Although a preferred embodiment of the invention is applicable to tendons having six wire strands helically wrapped about a center wire strand, the invention is applicable to multiple wire tendons having fewer or greater numbers of individual wires, or multiple wire layers. The dimensions and windings of various tendons will relate to the tendon strength but not to the anti-corrosive protection and capability for tensile movement provided by the present invention.

Figure 5:
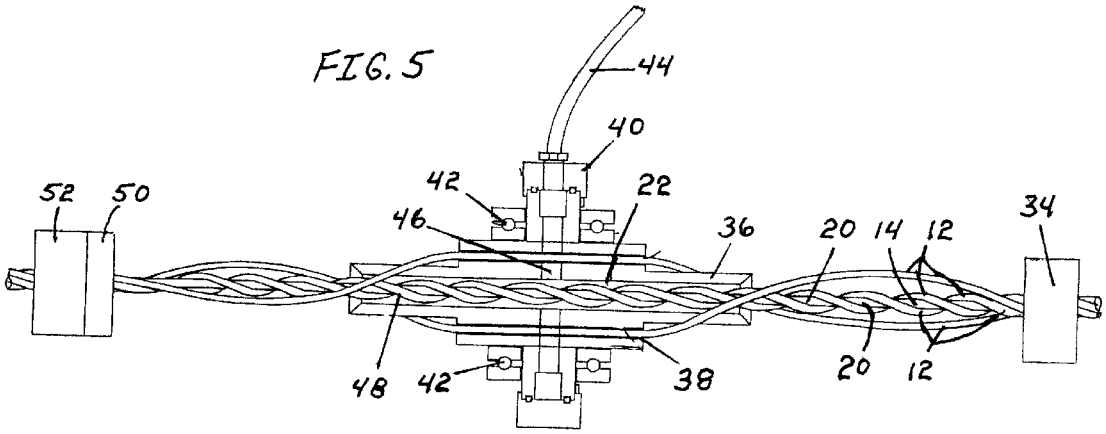
FIG. 5 illustrates a tool for packing corrosive resistant material into the interstices between individual wire strands.

FIG. 5 illustrates the application of corrosion resistant material 22 to interstices 20. As shown in FIG. 5, tendon 10 having six wire strands 12 is engaged with strand open restrictor 34. Restrictor 34 displaces three wire strands 12 radially outwardly from center wire 14, and the outward position is maintained by rotating opener 36 having apertures 38. Stationary applicator 40 is engaged by bearings 42 to rotating opener 36, and has supply line 44 for delivering corrosion resistant material 22 to application 40 and to nozzle 46. Strand filling tube 48 is filled with corrosion resistant material 22 and coats all sides of center wire 14 and wire strands 12 as such individual wires pass through strand filling tube 48. Wiper 50 removes excess corrosive resistant material 22 from such strands, and strand closing die 52 returns wire strands 12 to the original position relative to center wire 14. As reconfigured tendon 10 moves past closing die 52, first sheath 16 can be formed around the exterior surface of tendon 10 with conventional forming processes.

As closing die 52 reconfigures wire tendon 10 into the original shape having the original exterior configuration, the returned wire strands 12 automatically compress corrosion resistant material 22 to pack such material into interstices 20. In this manner, residual air pockets susceptible to water intrusion are eliminated. It should be noted that the invention does not require the displacement of all wire strands 12 radially outwardly from center wire 14 to thoroughly pack corrosive resistant material 22 within interstices 20. Depending on the number of wire strands 12 and the configuration of the tendon, the displacement of one or more wire strands 12 may be sufficient to accomplish the saturation of interstices 20.

Sufficient corrosive material 22 can be left in the helical grooves on the exterior surface of tendon 10 to form a substantially cylindrical first sheath 16 as shown in FIG. 1 suitable for independent use or in conjuction with second sheath 26 as illustrated in FIG. 2. Alternatively, excess corrosive material 22 can be removed from the exterior surface of tendon 10 to construct the cable embodiment illustrated in FIG. 3 wherein excess corrosive resistant material 22 fills a shaped annulus between the exterior surface of first sheath 16 and the inner cylindrical surface of second sheath 26.

Although FIG. 5 illustrates one technique for filling interstices 20, other techniques may be practiced within the scope of the invention to accomplish the desired result. Depending on the viscosity of corrosion resistant material 22 and the gaps or absence of gaps between wire strands 12, other techniques for saturating interstices 20 with corrosion resistant material 22 may or may not require displacement of one or more wire strands 12 away from center wire 14 or from other wire strands 12.

The present invention provides a unique post-tension tendon system having special applicability to multiple strand, unbonded applications. The invention provides superior anti-corrosion protection through the entire tendon length, and facilitates tendon tensioning after the surrounding concrete has cured. By providing a first sheath within a second sheath, the invention uniquely furnishes protection against tendon scarring and resulting water intrusion. By uniquely provided for a dual sheath system about the internal tendon, the sheath materials can be selected from material classes such as nylon, polymers, metals, or other organic or mineral or synthetic materials. The outer second sheath can be formed with a tough material resistant to punctures and stretching damage, while the interior first sheath can be formed with another material for retaining the corrosion resistant material.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. A tendon as for unbonded post-tension application, comprising:

a mono-strand tendon haying at least two wire strands, wherein said tendon has an exterior surface and has interstices between said wire stands;

a first sheath around said tendon exterior Surface for covering said tendon exterior surface, wherein said first sheath has an exterior surface;

a corrosion resistant material positioned within said interstices and between said tendon exterior surge and said first sheath; and a second sheath about said first sheath exterior surface.

2. A tendon as recited in claim 1, wherein said monostrand tendon comprises six wires helically wrapped around a center wire, wherein said tendon exterior surface includes helical grooves between adjacent wires, and wherein said corrosion resistant material fills said grooves to form a substantially cylindrical tendon exterior surface.

3. A tendon as recited in claim 1, wherein said first sheath has a thickness less than ten mils.

4. A tendon as recited in claim 1, further comprising a lubricant positioned between said second sheath and-said first sheath exterior surface.

5. A tendon for unbonded post-tension application, comprising:

a mono-strand wire tendon having at least two wires, wherein said monostrand wire tendon has an exterior surface and has interstices between said wire strands;

a first sheath around said tendon exterior surface and having a first sheath exterior surface;

a corrosion resistant material positioned within said tendon interstices and between said tendon exterior surface and said first sheath; and a second sheath about said first sheath exterior surface, wherein said second sheath has a substantially cylindrical interior surface.

6. A tendon as recited in claim 5, wherein said monostrand tendon comprises at least one wire helically wrapped around a center wire to form at least one helical groove, and wherein said corrosion resistant material fills said helical groove to maintain an interior surface of said first sheath in a substantially cylindrical shape.

7. A tendon as recited in claim 5, wherein said first sheath has a thickness less than ten mils and is fitted tightly against said tendon exterior surface.

8. A tendon as recited in claim 7, wherein said monostrand tendon comprises at least one wire helically wrapped around a center wire to form at least one helical groove in said first sleeve exterior surface, and further comprising corrosion resistant material within said helical groove between said first sheath and said second sheath interior surface.

9. A tendon as recited in claim 7, wherein said monostrand tendon comprises six wires helically wrapped around a center wire to form helical grooves between adjacent wires and in the exterior surface of said first sheath, and further comprising a lubricant in said helical grooves between said first sheath exterior surface and said second sheath interior surface.

* * * * *